United States Patent [19]

Moglia et al.

[11] 4,209,686

[45] Jun. 24, 1980

[54] ELECTRICAL RESISTANCE HEATER

[75] Inventors: Henry J. Moglia; Carlo B. Sonnino, both of St. Louis, Mo.

[73] Assignee: Emerson Electric Co., St. Louis, Mo.

[21] Appl. No.: 881,902

[22] Filed: Feb. 27, 1978

[51] Int. Cl.[2] ..... H05B 3/00

[52] U.S. Cl. ..... 219/375; 219/536; 219/541; 219/544; 338/290; 338/304

[58] Field of Search ..... 338/321, 322, 330, 331, 338/312, 306, 304, 305, 302, 303, 315, 264, 296–298, 316, 301, 318, 290, 57, 58; 219/541, 542, 546, 532, 544, 551, 355, 356, 375, 376, 374, 318, 307, 366–373, 377–382

[56] References Cited

U.S. PATENT DOCUMENTS

| | | | |
|---|---|---|---|
| 838,884 | 12/1906 | McElroy | 219/546 |
| 1,147,951 | 7/1915 | Kitchen | 219/366 |
| 1,374,658 | 4/1921 | Hohnsbeen | 219/375 |
| 1,468,593 | 9/1923 | Erb | 338/58 |
| 1,508,735 | 9/1924 | Weiss | 338/58 |
| 1,561,814 | 11/1925 | Aske | 219/546 |
| 1,712,010 | 5/1929 | Somes | 338/305 |
| 1,952,405 | 3/1934 | Apple | 338/301 |
| 2,537,821 | 1/1951 | Fodor | 219/369 |
| 2,694,765 | 11/1954 | Hynes | 338/318 |
| 2,834,866 | 5/1958 | Bentzman | 219/374 |

FOREIGN PATENT DOCUMENTS

| | | | |
|---|---|---|---|
| 21596 | of 1904 | United Kingdom | 338/301 |
| 5723 | of 1912 | United Kingdom | 338/301 |
| 833784 | 4/1960 | United Kingdom | 219/377 |

*Primary Examiner*—B. A. Reynolds
*Assistant Examiner*—Bernard Roskoski
*Attorney, Agent, or Firm*—Charles E. Markham

[57] ABSTRACT

An electrical resistance heater comprises a unitary ceramic coil support and mounting member having a horizontally elongated coil support portion around which a helical coil of conductive wire is wound and a vertically downward extending leg portion at each end thereof extending through apertures in a mounting plate. The leg portions have vertical slots therein receiving terminal posts extending through the mounting plate and the leg portions being further provided with horizontal grooves therein receiving deformable portions of the mounting plate to rigidly connect the support member thereto.

10 Claims, 11 Drawing Figures

ELECTRICAL RESISTANCE HEATER

This invention relates to exposed wire coil electrical resistance heaters of the type, for example, employed in domestic dishwashers to heat drying air and particularly to a novel unitary dielectric coil support and mounting member.

Heretofore, the coil support and mounting means for electrical resistance heaters of this type have included a plurality of connected components of both ceramic and metallic material. For example, in the application of John W. Moore, Ser. No. 744,184, filed Nov. 22, 1976, and now abandoned of common assignee, the heater coil support and mounting means of FIGS. 1 and 2 comprises a ceramic coil support member 10, a metal mounting strap 11, and two pairs of interlocking ceramic spools 24 and 25 for a total of six components in addition to the terminal posts 21 and 22.

The primary object of this invention is to provide a generally new and simplified construction of a heater of this type in which substantial economy is achieved over previous construction by reducing to a minimum the number of component parts required to support and mounted the heater coil on a mounting plate and insulate terminal posts extending therethrough.

A further object is to provide a unitary heater coil support and mounting member of ceramic material arranged to be mounted on a metal mounting plate or wall and having portions extending through the plate for connection thereto and for the insulated extension of the coil ends through the plate for connection with power source leads on the other side thereof.

Other objects and advantages will appear when reading the following description in connection with the accompanying drawings.

Figures 1, 2, 3, 4, 5, 6:
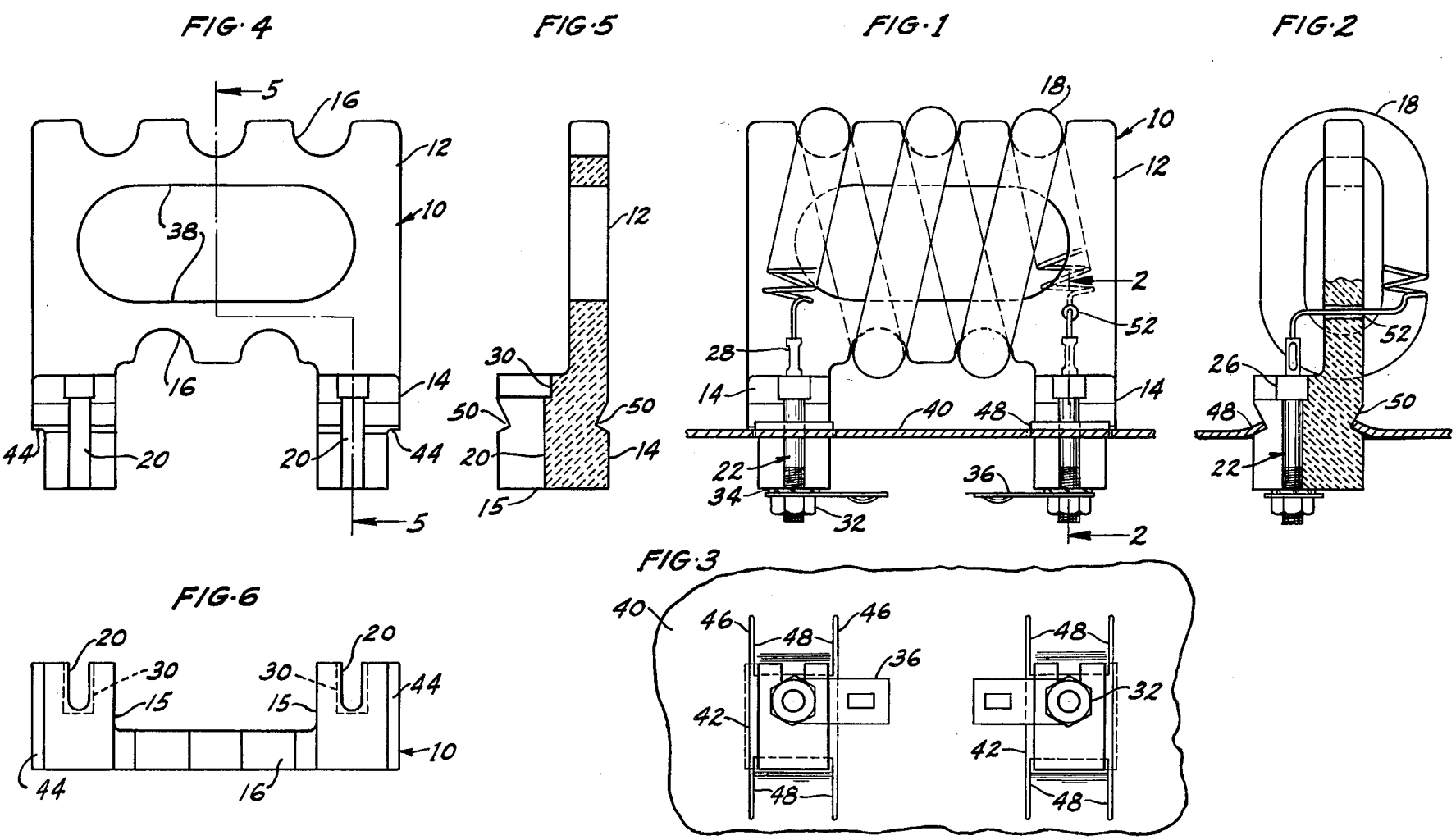
FIG. 1 is a front side elevational view of an electrical resistance heater constructed in accordance with the present invention, shown rigidly mounted on a support plate.
FIG. 2 is an end elevational view of the heater shown in FIG. 1 with a portion thereof sectionalized along line 2—2 of FIG. 1.
FIG. 3 is a bottom plan view.
FIG. 4 is a front side elevational view of the coil support and mounting member shown alone.
FIG. 5 is a cross-sectional view taken along line 5—5 of FIG. 4.
FIG. 6 is a bottom plan view of the coil support and mounting member shown in FIG. 4.

Referring to FIGS. 1 to 6 of the drawings, a cast and sintered ceramic coil support and mounting member is generally indicated at 10. Member 10 has a flat, rectangular, horizontally elongated coil support portion 12 and a downwardly extending mounting leg portion 14 at each end thereof. The upper horizontal edge of portion 12 and the lower horizontal edge thereof extending between leg portions 14 are provided with spaced recesses 16, preferably arcuate in shape, and of sufficient depth to receive and retain therein transverse portions of a helically wound wire coil 18, of suitable resistance, wound around portion 12.

The downwardly extending leg portions 14 are rectangular in cross-section and are considerably thicker front to back than the upper portion 12, with the rear sides of the leg portions flush with the rear side of portion 12 and with the front sides of leg portions 14 spaced forward from the front side of portion 12 thereby to form forwardly extending lug portions 15. There are deep grooves 20 in the front sides of lug portions 15 extending vertically the length of leg portions 14 and receiving terminal posts 22. Terminal posts 22 each comprise a cylindrical bolt portion 24 having a screw-threaded lower end portion, a square head portion 26 at the upper end thereof, and a deformable tube portion 28 extending upward from the square head portion 26 and receiving and clamping therein an end of the wire coil 18.

Short upper end portions of recesses 20 have increased width and depth, as indicated at 30, and receive the square head portions 26 of terminal posts 22 in fitting relationship, thereby to preclude rotation of the terminal posts. The cylindrical bolt portions 24 of the terminal posts extend downward below the ends of leg portions 14 and are provided with nuts 32 and lock washers 34. Suitable terminal connectors 36 for connection of power source leads are clamped between nuts 32 and washers 34. To conserve material, the upper portion 12 of the ceramic support member 19 is provided with a large aperture 38. In order to preclude the possibility of the terminal posts moving outward from their positions at the bottom of grooves 20 after assembly and tightening of nuts 32, the recesses are at least partially filled with a Sauerisen cement.

A mounting plate for the heater, indicated fragmentarily at 40, is provided with rectangular apertures 42 through which lower portions of legs 14 extend. These lower portions of legs 14 are reduced in width to form shoulders 44, which provide rest surfaces and limit the extension of legs 14 through the plate 40. The mounting plate 40 is further slit in line with opposite sides of apertures 42, as indicated at 46, to provide front and rear, upwardly angled, deformable tongues 48 which are bent downward upon assembly and enter into horizontal V-grooves 50 in the front and rear sides of legs 14 to rigidly connect the member 10 to plate 40. The upward extending surfaces of horizontal V-grooves 50 lie at substantially greater angle to the horizontal than do the downwardly extending surfaces thereof, thereby to permit entry of the free ends of deformable tongues 48 into grooves 50 as they are bent downward.

It will be noted that the downwardly directed end portions of a heater coil wrapped around a horizontal support member will always lie on opposite sides of the support member, and in previous constructions, the terminal posts and their ceramic insulators were accordingly positioned on opposite sides of the support member. Considerable economy is achieved, however, when forming the support member 10 as a casting of ceramic material, if the terminal post receiving leg portions 15 are extended from the same side. To accommodate this arrangement, one downwardly directed end portion of coil 18 is threaded through an aperture 52 in support member 10. Also, this arrangement will require one less recess 16 in the lower horizontal surface of coil support portion 12 than in the upper horizontal surface thereof.

Figure 7:
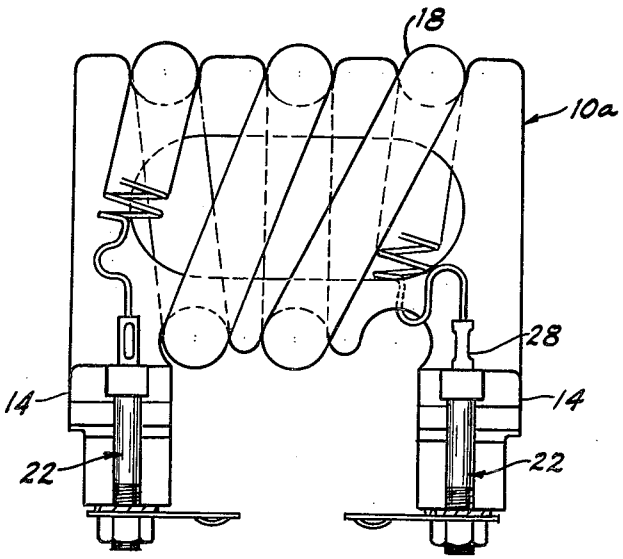
FIG. 7 is a front side elevational view of a modified form of the electrical resistance heater shown in FIGS. 1 to 6.
Figure 9:
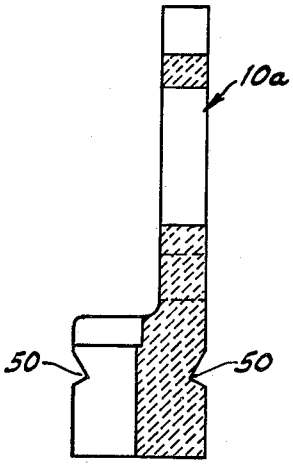
FIG. 9 is a cross-sectional view taken along line 9—9 of FIG. 8.
Figure 8:
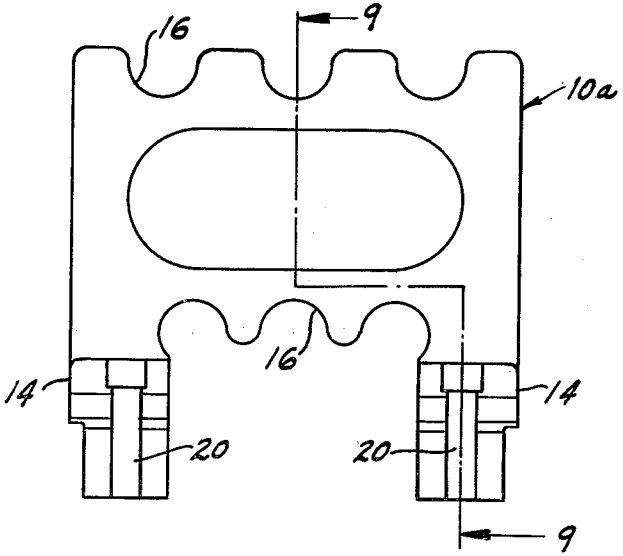
FIG. 8 is a front elevational view of the coil support and mounting member employed in the modified form shown in FIG. 7.
Figure 10:
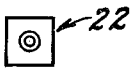
FIGS. 10 and 11 are top end and side elevational views, respectively, of the terminal posts.
Figure 11:
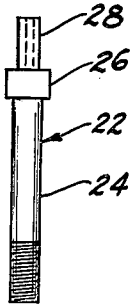

The modification of the heater shown in FIGS. 7 to 9 of the drawings differs from the described heater of FIGS. 1 to 6 only in the manner of bringing one downwardly directed end portion of the coil 18 to the front side of the coil support and mounting member for connection to a terminal post. In this arrangement, a coil support and mounting member, generally indicated at 10*a*, is employed, having an equal number of coil receiving recesses 16 in the upper and lower horizontal surfaces of the portion 12, and one downwardly directed end portion of coil 18 is brought to the front side of member 10*a* through one of the recesses 16 in the lower horizontal surface. By providing an equal number of coil receiving recesses instead of merely providing a narrow slot in the lower surface through which to pass one end portion of the coil wire, the arrangement is made symmetrical, thus permitting the coil winding to be started from either end.

It will be understood that while we prefer to position the terminal post receiving lugs 15 on the same side so as to effect an economy of construction, they may be positioned on opposite sides without departing from the spirit of the invention. Also, other means of rigidly attaching the leg portions of support member 10 to the support plate, involving the entry of attaching elements into grooves or recesses in the leg portions, will occur to those skilled in the art and the exclusive use of any such means is contemplated.

The foregoing description is intended to be illustrative, not limiting, the scope of the invention being set forth in the appended claims.

What we claim is:

1. A unitary ceramic support member for a helically wound electrical resistance heater coil comprising: a flat plate-like coil support portion having front and rear sides, opposite parallel and coextending edges, and an integral leg extending perpendicularly in the plane of said flat coil support portion from each end of one of said edges for mounting said member on support structure and for spacing said flat coil support portion therefrom, said edges of said coil support portion each having a plurality of spaced recesses therein for receiving and retaining transversely extending portions of a heater coil when wrapped around said flat coil support portion, and said legs being thicker front to rear than said flat coil support portion with each having a portion thereof offset from one side of said coil support portion, and each of said legs having a groove in said offset portion thereof extending longitudinally the length thereof for receiving a rigid terminal post.

2. The support member claimed in claim 1 in which said offset portions of both of said legs project forward from the front side of said flat coil support portion and in which said grooves are in the front sides thereof.

3. The support member claimed in claim 2 having an aperture extending through said flat coil support portion from side to side and adjacent the inner end of one of said legs for the passage of one end of a heater coil from one side to the other of said portion.

4. The support member claimed in claim 2 having a recess in said one of said edges of said support portion adjacent the inner end of one of said legs for the passage of one end of a heater coil from one side of said support portion to the other.

5. A unitary dielectric coil support and mounting member for an electrical resistance heater coil adapted to be mounted in an apertured mounting plate, said member comprising a flat coil support portion having front and rear sides, opposite and coextending edges, and a leg extending perpendicularly in the plane of said flat coil support portion from each end of one of said edges for longitudinal entry into apertures in a mounting plate, said opposite coextending edges each having a plurality of spaced heater coil receiving recesses therein, said leg portions being thicker than said flat coil support portion and having a portion thereof offset from one side of said coil support portion, and each of said legs having a groove in said offset portion thereof extending longitudinally the length thereof for receiving a terminal post, the cross section of outer end portions of said legs being reduced to provide transverse shoulders thereon to limit their entry into apertures in a mounting plate, and said legs being further provided with transverse grooves intermediate of their length in opposite surfaces thereof and lying at 90 degrees from said transverse shoulders for receiving the edges of attaching elements for connecting said member to the mounting plate.

6. The unitary dielectric coil support and mounting member claimed in claim 5 being constructed of a ceramic material with the front surfaces of said offset leg portions spaced outward from the front side of said support portion and with said longitudinally extending terminal post receiving grooves formed in the front sides of said leg portions.

7. In an electrical resistance heater, an apertured mounting plate, a unitary dielectric coil support and mounting member comprising a flat coil support portion having front and rear sides, opposite, parallel and coextending edges each having a plurality of spaced coil receiving recesses therein, and an integral leg extending perpendicularly from each end of one of said legs and entered longitudinally into an aperture in said mounting plate, a heater coil wrapped around said coil support portion and entered into said recesses, said legs being thicker than said flat coil support portion and each having a portion thereof offset from one side of said coil support portion, and each of said legs having a longitudinal groove in said offset portion and extending the length thereof, a terminal post entered into each of said longitudinal grooves and being connected at one end to an end of said heater coil, said leg portions being provided with transverse shoulders thereon intermediate of their length to limit longitudinal entry of said leg portions into said plate apertures, and said leg portions being further provided with transverse grooves therein intermediate of the length thereof on opposite sides thereof and extending perpendicular to said transverse shoulders for receiving attaching elements connecting said member to said mounting plate.

8. The electrical resistance heater claimed in claim 7 in which said transverse grooves in said leg portions have at least one outwardly diverging side, and in which said attaching elements are partially detached, deformable portions of said mounting plate.

9. The electrical resistance heater claimed in claim 7 in which said coil support and mounting member is constructed of a ceramic material and has front and rear sides, in which the front surfaces of said thicker leg portions are spaced outwardly from the front side of said coil support portion, and in which said longitudinal terminal post receiving grooves are formed in the front sides of said legs.

10. The electrical resistance heater claimed in claim 7 in which said longitudinal terminal post receiving grooves are at least partially filled with cement after the terminal posts are assembled therein.

* * * * *